US005538188A

United States Patent [19]

Simonette

[11] Patent Number: 5,538,188

[45] Date of Patent: Jul. 23, 1996

[54] FLOW NOZZLE

[75] Inventor: Dallas Simonette, Andover, Minn.

[73] Assignee: General Pump/US, Inc., Mendota Heights, Minn.

[21] Appl. No.: 373,599

[22] Filed: Jan. 17, 1995

[51] Int. Cl.[6] ..... B05B 1/00

[52] U.S. Cl. ..... 239/599; 239/591

[58] Field of Search ..... 239/690, 708, 239/DIG. 19, 597, 598, 599, 600, 591; 29/447; 264/DIG. 75, DIG. 76; 425/555

[56] References Cited

U.S. PATENT DOCUMENTS

| | | | |
|---|---|---|---|
| 3,698,635 | 10/1972 | Sickles | 239/706 X |
| 3,731,881 | 5/1973 | Dixon et al. | 239/585.3 |
| 5,415,768 | 5/1995 | Andelman | 210/198.2 |

OTHER PUBLICATIONS

"Ceramic–reinforced nylon suitable for metal replacement" article from Plastics Design Forum Products & Services–Jul./Aug. 1992.

"P1 and P6 Series chemically coupled glass fiber reinforced polypropylene" by Thermofil.

"NSC™ Esbrid™ Ceramic Fiber/Glass Fiber Reinforced Nylon" brochure by Thermofil.

*Primary Examiner*—Kevin P. Weldon
*Attorney, Agent, or Firm*—Janal M. Kalis

[57] ABSTRACT

The present invention includes a flow nozzle with a main body having an annular inlet and an annular outlet. The annular outlet includes a material of fiberglass and ceramic-filled nylon that encloses the orifice. The present invention also includes a method for making a flow nozzle. The method includes providing a main body with an annular inlet and an annular outlet. Next, the main body is positioned in a mold and is molded with a material that includes fiberglass and ceramic-filled nylon so that the fiberglass and ceramic-filled nylon is molded onto the annular outlet. An orifice is defined by the fiberglass-ceramic-nylon material.

9 Claims, 2 Drawing Sheets

FLOW NOZZLE

BACKGROUND OF THE INVENTION

The present invention relates to a flow nozzle.

Conventional flow nozzles typically have a main body with an inlet for streamlined, uncontracted fluid flow and an outlet having an opening that directs fluid into an open space. Some nozzles, such as needle nozzles, project fluid in a jet flow into the open space. Other nozzles disperse fluid in an atomized mist.

Nozzles may be integral components of machines such as an internal combustion engine. Nozzles may also be separate interchangeable components such as on a fire truck or in a car wash.

Flow nozzles have a coefficient of discharge that is about the same as for a venturi meter. This is because flow nozzles can be regarded as venturi meters that lack long diffusers at the outlet. Unlike venturi metered flow, the fluid jet produced by flow nozzles is permitted to expand of its own accord creating a high degree of turbulence downstream from the nozzle. This turbulence results in a greater loss of head as compared to what occurs in a venturi meter.

The relationship of flowrate to head and flow nozzle dimensions has been quantified as follows:

$$1.\quad Q = CA_2\sqrt{2gh}\ /\sqrt{1-R^4}$$

$$2.\quad Q' = 3.118CA'_2\sqrt{2gh}\ /\sqrt{1-R^4}$$

where Q= rate of flow, feet$^3$/s; C= coefficient of discharge from nozzle; $A_2$=area of nozzle throat, feet$^2$; g= acceleration of gravity, 32.17 feet/$^{sec2}$; h=head at or across the nozzle, feet; R= ratio of throat diameter to inlet diameter, $D_2/D_1$; Q'= rate of flow, GPM; $A_2$'= area of nozzle throat, in$^2$.

Thus, the rate of flow from a nozzle is proportional to the area of the nozzle throat, the coefficient of discharge for the nozzle and the fluid head across the nozzle.

In addition to flow rate, nozzles produce a particular pattern of flow. As discussed, nozzles have no diffuser component to alter the dispersion of fluid from the nozzle. Thus, each nozzle-type has its own unique and particular dispersion pattern. The dispersion pattern is dependent upon conformational features of the nozzle. Spray patterns as manifested in two dimensions, include an annular pattern produced by a hollow cone nozzle, a circle produced by a full cone nozzle, a point produced by a solid stream nozzle, an ellipse produced by a flat spray nozzle, an annulus produced by a fine spray nozzle and a variety of patterns produced by air atomizing.

Conventional nozzles are made of materials such as brass and stainless steel. Typically, the entire nozzle is fabricated from the same metal material or a combination of metal materials. A particular spray pattern is produced by the size and shape of the opening made in the outlet end of the nozzle.

The conventional nozzles may be threaded on an external surface. Conventional nozzles may also have a mechanism for quick connect and disconnect that includes an outer plastic collar that is attachable to the metal nozzle. The threads and quick connect and disconnect mechanism permit the nozzle to be connected to another component of a machine or to a hose.

SUMMARY OF THE INVENTION

The present invention includes a flow nozzle that has a main body with an annular inlet and an annular outlet defining a constricting flow orifice. The annular outlet is made of a material that includes fiberglass and ceramic filled nylon in a concentration within a range of about 50% to 65% by weight.

The present invention also includes a process for making a flow nozzle. The process includes providing a main body having an annular inlet and an annular outlet. The main body is positioned in a mold. A material that includes fiberglass and ceramic filled nylon in a concentration within a range of about 50% to 65% by weight is molded to the main body at the annular outlet. The material is molded so that a constricting flow orifice is defined by the material at the outlet end.

BRIEF DESCRIPTION OF PREFERRED EMBODIMENT

Figure 1:
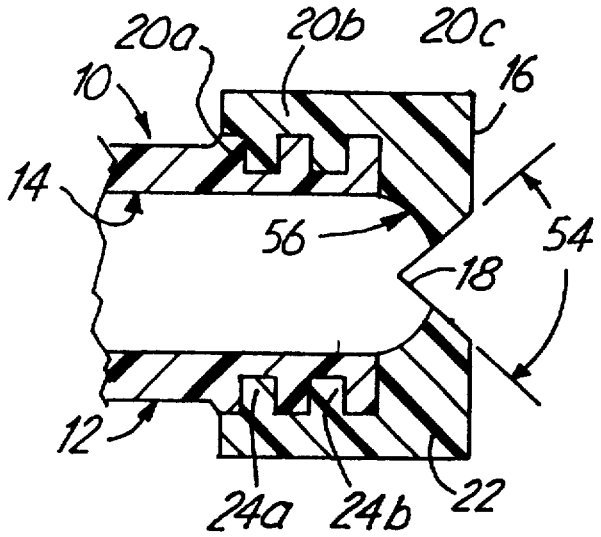
FIG. 1 illustrates a cross-sectional side view of one embodiment of the nozzle of the present invention.

The flow nozzle of the present invention illustrated generally at 10 in FIG. 1 includes a main body 12 having an annular inlet portion 14 and a constricted flow outlet portion 16 with opening 18 that opposes the annular inlet 14. The constricted flow outlet portion 16 is made of a material that includes fiberglass and ceramic filled nylon in a concentration ranging from about 50% to 65% of the material by weight. The material has a commercial designation, "Esbrid NSG or LSG grades 240A, 440A, and 730A," and is obtained from THERMOFIL, Inc. of Brighton, Mich. The Esbrid NSG or LSG material defines the opening 18.

The flow nozzle 10 is made in a process that includes providing a main body having an annular inlet and annular outlet and a mold, inserting the main body in the mold and adding the fiberglass and ceramic filled nylon material, and molding the fiberglass and ceramic filled nylon material to the main body so that the fiberglass and ceramic filled nylon material is bonded to the main body forming the constricted outlet 16 with opening 18.

In one other embodiment, the flow nozzle is made in a mold that forms both the main body and constricted outlet. With this embodiment, the flow nozzle is made of a single material, the fiberglass and ceramic filled nylon material.

By manufacturing the flow constricting outlet portion 16 with the fiberglass and ceramic filled nylon material, shrinkage is unexpectedly and remarkably reduced. As a consequence, nozzles made in accordance with the process of the present invention are manufactured within a narrow tolerance range.

Making products that meet a specified tolerance range in a plastic molding process is critically important in achieving efficiency in the process. Components made in the molding process that fail to fall within a prescribed tolerance range must be rejected and become waste material. That the flow nozzle of the present invention predictably and consistently meets tolerances of 0.001 inches per inch or less is remarkable and unexpected. Because of the unexpected predictability in meeting tolerance as a consequence of the process and product of the present invention, costs for manufacturing the flow nozzle are believed to be reduced by over four-fold as compared to costs in conventional processes.

Furthermore, the unexpected improvements in shrinkage and tolerance occur without penalty with respect to material strength, stability, and durability. Remarkably, nozzle strength and durability are improved with the process of the present invention as compared to most conventional nozzle construction processes. The fiberglass and ceramic filled nylon material has a resistance to corrosion and ultraviolet light.

It has further been found that the use of the fiberglass and ceramic filled nylon material imparts a feature to the nozzle wherein the nozzle is reversibly deformable. Hence, the nozzle displays excellent and unexpected wear properties. In particular, the nozzle of the present invention displays resistance to blows and other "impact type" forces.

It is believed that the ceramic component of the fiberglass and ceramic filled nylon material imparts rigidity to the outlet portion of the nozzle. However, the nylon component imparts a deformability to the nozzle. The combination of ceramic and nylon imparts a reversible deformability to the nozzle 10, at the outlet end 16. One other feature of the fiberglass and ceramic filled nylon material is that the material is slippery, thereby promoting flow generally through the nozzle and through the orifice 18 at the outlet of the nozzle 10.

The fiberglass and ceramic filled nylon materials include ceramic fiber and glass fiber reinforced nylons. One type of fiberglass and ceramic filled nylon, Esbrid NSG-240A, includes a nylon 6 type resin with a total of 50 percent reinforcement content by weight. Another type of fiberglass and ceramic filled nylon material is a nylon 6 type resin with a total of 60 percent ceramic and glass fiber reinforcement by weight. One other material, the Esbrid NSG-730A, is a nylon 6 resin with a 65 percent total reinforcement content.

The fiberglass and ceramic filled nylon materials have a tensile strength that ranges from 23,000 to 30,000 psi as measured by ASTM procedure D638, a flexural strength that ranges from 38,000 to 45,000 psi as measured by ASTM procedure D790, a flexural modulus that ranges from 1,800,000 to 2,150,000 psi as measured by ASTM procedure D790 and a notched izod impact test that ranges from 1.6 to 2 ft.-lbs./in. as measured by ASTM procedure D256. The fiberglass and ceramic filled nylon materials have a heat deflection temperature (HDT) that ranges from 410 to 495 degrees F. at 264 psi as measured by ASTM procedure D648 and a specific gravity that ranges from 1.59 to 1.81 as measured by ASTM procedure D792.

The opening 18 defined by the fiberglass and ceramic filled nylon may be molded to a size and shape permitting flow through the nozzle 10 over a wide range of nozzle numbers. A nozzle number refers to flow in gallons per minute (gpm) at 4000 psi, i.e. a nozzle number of 8 refers to a flow of 8 gpm at 4000 psi. The fiberglass and ceramic filled nylon may also be molded to enclose an opening 18 permitting flow through the nozzle 10 at pressures as low as 60 to 80 psi. Nozzle embodiments shown in FIG. 1 and FIG. 4 may be sized over a wide range of nozzle numbers.

Figure 4:
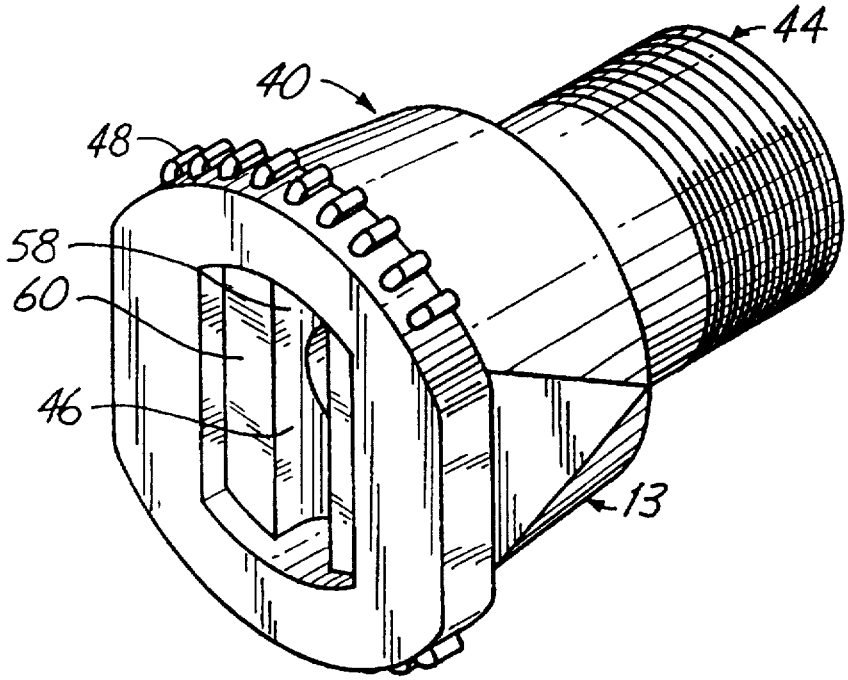
FIG. 4 illustrates a perspective view of another embodiment of the nozzle of the present invention.

In the embodiment shown at 40 in FIG. 4, an outlet 46 is defined by an oblique surface 58. An offset surface 60 is integral to the oblique surface 58 and intersects a radius 56, shown in FIG. 5 at an angle 54 to impart a spray angle of 65 degrees to the nozzle. In the case of FIG. 4, the angle 54 is about 80 degrees. The angle of offset 54 and opening 46 size and shape are important factors in imparting nozzle number and spray angle to the nozzle 40.

The main body 12 of the flow nozzle 10 is acceptably made from any conventional flow nozzle material or collection of flow nozzle materials. For instance, the main body may be made of a material such as brass or stainless steel and include an outer polymeric segment. The main body may also be made of the fiberglass and ceramic filled nylon material. The outer polymeric segment may include threads or other connecting-type features that enable the nozzle to be fitted to a larger piece of equipment.

The fiberglass and ceramic filled nylon material is colorable with dyes. The dyes may be either molded into the material or painted onto the material. Consequently, the outlet 16 may be color coded with respect to particular spray angles.

The main body of the present invention may be made by any conventional nylon molding procedure. In one embodiment, the main body defines an orifice (not shown) at the outlet. It is not necessary for the process or product of the present invention, however, that the orifice be precisely shaped. To the contrary, it is preferred that the orifice have a conventional shape that can be precisely defined by the molding of the fiberglass and ceramic filled nylon material to the main body 12 and defining size and shape of the orifice 18.

The orifice 18 is defined by the fiberglass and ceramic filled nylon material in the nozzle of the present invention 10. In one embodiment, illustrated in FIG. 6, the orifice 18 is defines by an oval-shaped surface 52 made of the fiberglass and ceramic filled nylon material.

Figure 6:
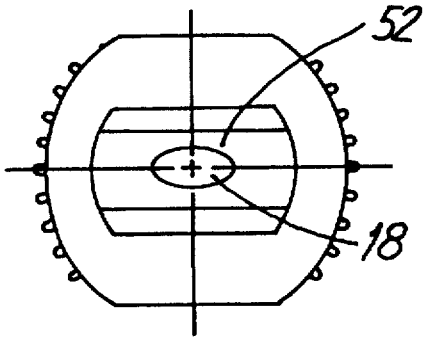
FIG. 6 illustrates a front view of the other embodiment of the nozzle of the present invention.

The embodiment in FIG. 6 is a cross-section of a nozzle embodiment at 40 in FIG. 4. The nozzle embodiment 40 includes a main body 13 with an annular inlet 44 and the outlet 46. The main body 13 includes fingers 48 for gripping the nozzle 40.

In the embodiment shown in FIG. 1, the main body 12 has ridges 20 and valleys 24 that extend annularly about the main body 12 proximal to the outlet end 16. The ridges **20*a*, 20*b* and 20*c* and valleys 24*a* and 24*b* provide a greater surface for tightly bonding the fiberglass and ceramic filled nylon material to the main body 12. Further, the proximal distribution of the material defining each ridge and the fiberglass and ceramic filled nylon material forms a composite that is stronger than either material considered separately. In the process for making the flow nozzle of the present invention 10, a cylindrical section 22 made of fiberglass and ceramic filled nylon is molded to the main body 12 and over the ridges 20*a-c* and valleys 24*a* and *b***.

Figure 5:
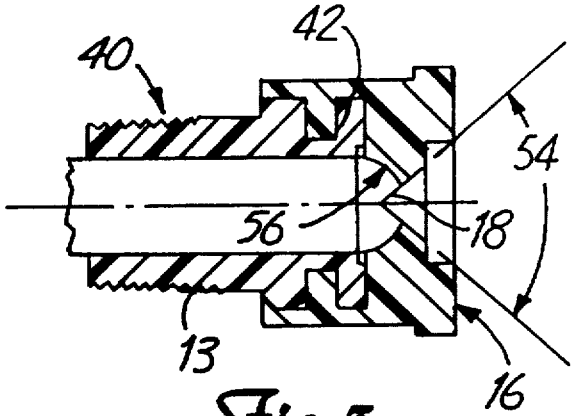
FIG. 5 illustrates a cross-sectional side view of the other embodiment of the nozzle of the present invention.

In one other embodiment of the present invention illustrated at 40 in FIG. 5, the number of ridges is reduced to one ridge 42. The height of the this ridge 42 is minimized in order to streamline the ridge 42. It is believed that this type of ridge configuration will reduce failure of the flow nozzle by having less susceptibility to process conditions.

The reduction of ridge number and height and streamlining of ridge conformation is made possible because the fiberglass and ceramic filled nylon material used in the outlet component of the present invention bonds with the underlying main body material 12 much more tenaciously than bonding that occurs with conventional polymers. This bonding is believed to occur because the fiberglass and ceramic filled nylon material does not shrink to a degree of other plastic materials. The ceramic filled nylon material has displayed a mold shrinkage of 0.001 to 0.002 in./in. as measured by ASTM test method of D955.

The feature of one embodiment of the process and product of the present invention of combining different types of material to make a final molded flow nozzle 10 creates a synergistically improved flow nozzle. By taking advantage of the best attributes of metal and the fiberglass and ceramic filled nylon polymer, a flow nozzle can be made having properties synergistically enhanced as compared to a flow nozzle made of either metal or plastic.

To make the flow nozzle of the present invention, the fiberglass and ceramic filled nylon polymer is molded to the main body in a conventional mold under conditions of temperature and time that are conventionally used for nylon. The nozzle is preferably made in a two-plate mold. The two-plate mold has a single surface where the mold separates to permit ejection of plastic. The two plate mold may be part of a larger molding system wherein 8 to 10 nozzles may be automatically manufactured at any one time.

Figure 2:
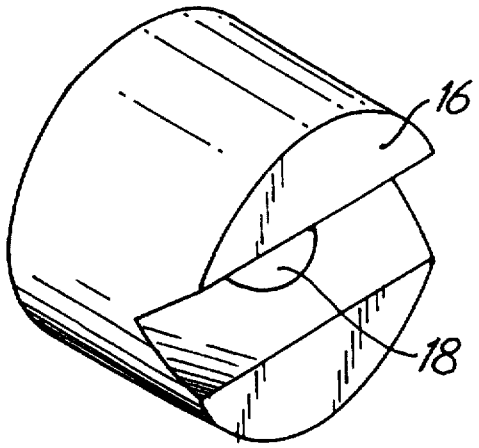
FIG. 2 illustrates a perspective view of one embodiment of the nozzle of the present invention.
Figure 3:
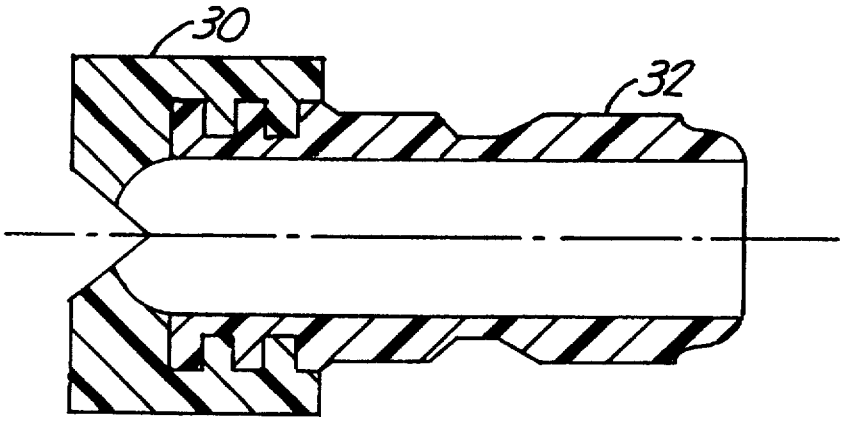
FIG. 3 illustrates a cross-sectional side view of the flow nozzle of the present invention.

One embodiment of the molded outlet 16 of the nozzle 10, shown in FIG. 2, is a "flat" spray nozzle. Another type of flat spray nozzle, such as is illustrated at 40 in FIG. 4, may also be constructed by the process of the present invention, however. It is believed that the process of the present invention may be used to make hollow cone nozzles, full cone nozzles, solid stream nozzles, fine spray nozzles and air atomizing nozzles.

Although the present invention has been described with reference to preferred embodiments, workers skilled in the art will recognize that changes may be made in form and detail without departing from the spirit and scope of the invention.

What is claimed is:

1. The flow nozzle comprising a main body with an inlet and an outlet wherein the outlet has an orifice defined by a material that includes nylon with a fiberglass and ceramic fill and wherein the nylon material is shrink bonded to the main body.

2. The flow nozzle of claim 1 wherein the fiberglass and ceramic fill of the nylon has a concentration within a range of about 55% to 65% by weight.

3. The flow nozzle of claim 1 wherein the main body is made of the material that includes nylon with a fiberglass and ceramic fill.

4. The flow nozzle of claim 1 wherein the main body is made of a metal.

5. The flow nozzle of claim 1 wherein the main body includes a ridge and a valley for bonding the material that includes nylon with a fiberglass and ceramic fill to the main body.

6. A method for making a flow nozzle comprising:

providing a main body with an inlet and an constricted outlet;

positioning the main body in a mold;

molding a material that includes fiberglass and ceramic filled nylon onto the constricted outlet wherein an orifice is defined by the fiber glass-ceramic-nylon material.

7. The method of claim 6 wherein the fiberglass and ceramic fill of the nylon has a concentration within a range of about 55% to 65% by weight.

8. The method of claim 6 wherein the main body is made of metal.

9. The method of claim 6 wherein the main body is made of the fiberglass and ceramic filled nylon material.

* * * * *